US008382487B2

(12) United States Patent
Jeon et al.

(10) Patent No.: US 8,382,487 B2
(45) Date of Patent: Feb. 26, 2013

(54) LAND GRID ARRAY INTERCONNECT

(75) Inventors: Myoungsoo Jeon, Harrisburg, PA (US); Attalee Snarr Taylor, Palmyra, PA (US); Craig Warren Hornung, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 80 days.

(21) Appl. No.: 12/973,071

(22) Filed: Dec. 20, 2010

(65) Prior Publication Data

US 2012/0156899 A1 Jun. 21, 2012

(51) Int. Cl.
*H01R 12/00* (2006.01)

(52) U.S. Cl. ..... 439/66; 439/83

(58) Field of Classification Search ..... 439/66, 439/71, 83, 91, 591
See application file for complete search history.

(56) References Cited

U.S. PATENT DOCUMENTS 5,152,695 A * 10/1992 Grabbe et al. ..... 439/71
5,173,055 A * 12/1992 Grabbe ..... 439/66
5,772,451 A 6/1998 Dozier, II et al.
6,142,789 A 11/2000 Nolan et al.
6,532,654 B2 * 3/2003 Guerin et al. ..... 29/884
6,926,536 B2 * 8/2005 Ochiai ..... 439/66
7,173,441 B2 * 2/2007 Kister et al. ..... 324/756.03
7,189,077 B1 * 3/2007 Eldridge et al. ..... 439/66
7,371,073 B2 5/2008 Williams
7,628,617 B2 * 12/2009 Brown et al. ..... 439/66
7,773,388 B2 * 8/2010 Kariya et al. ..... 361/776
8,007,287 B1 * 8/2011 Champion et al. ..... 439/66
8,033,835 B2 * 10/2011 Mulfinger et al. ..... 439/66

* cited by examiner

*Primary Examiner* — Thanh Tam Le

(57) ABSTRACT

A land grid array interconnect has a substrate that has a first surface and a second surface. The substrate has a plurality of vias extending therethrough. The substrate has first pads on the first surface electrically connected to corresponding vias and has second pads on the second surface electrically connected to corresponding vias and corresponding first pads. A contact array is coupled to the first surface of the substrate. The contact array has a metal plate that defines a carrier and a plurality of contacts formed from the metal plate and held by the carrier. The contacts have contact heels and beams extending from corresponding contact heels. The contact heels are soldered to corresponding first pads. The contacts are singulated from the carrier after the contact heels are soldered to the first pads. The carrier is removed from the substrate after the contacts are singulated leaving the individual contacts soldered to corresponding first pads.

16 Claims, 7 Drawing Sheets

LAND GRID ARRAY INTERCONNECT

BACKGROUND OF THE INVENTION

The subject matter herein relates generally to a land grid array (LGA) interconnect and method of manufacturing the same.

Various packages or devices exist within the computer industry which require interconnection to a printed circuit board. The devices have lands or balls which are placed on 1.0-mm centerline spacing and below. The devices are profiled with arrays of 50 by 50 and even greater. Given the plurality of lands, their centerline spacing, and given the force applied to each land, the devices cause a variety of problems in practice in connection to the printed circuit board.

Sockets exist within the market for the interconnection of such devices, where the sockets include a substrate having contacts terminated to one side of the substrate for connection to the package or device and contacts or balls terminated to the other side of the substrate for connection to the printed circuit board. The contacts have centerline spacings that correspond with the spacing of lands or balls on the device. Attachment of the contacts to the substrate, particularly when the centerline spacing is small, is difficult and time consuming. Some known sockets, such as the contact grid array system described in U.S. Pat. No. 7,371,073 to Williams, use a contact array that is bonded to a dielectric substrate, which is then bonded to an interposer substrate. The contacts are then plated to create a conductive path from the contacts to a conductive layer on the interposer substrate. A 3D photo resist process is used to plate the contact array and the substrate. The 3D photo resist process has a high cost and low yield associated therewith. Additionally, attachment of the substrate to the interposer substrate is time consuming. For example, the contact array and substrate are laminated to the interposer substrate, requiring a 1-2 hour cure time.

A need remains for an LGA interconnect socket that may be manufactured in a cost effective and reliable manner. A need remains for an LGA interconnect socket having high density that may be manufactured in a timely and cost effective manner.

BRIEF DESCRIPTION OF THE INVENTION

In one embodiment, a land grid array interconnect is provided having a substrate that has a first surface and a second surface. The substrate has a plurality of vias extending therethrough. The substrate has first pads on the first surface electrically connected to corresponding vias and has second pads on the second surface electrically connected to corresponding vias and corresponding first pads. A contact array is coupled to the first surface of the substrate. The contact array has a metal plate that defines a carrier and a plurality of contacts formed from the metal plate and held by the carrier. The contacts have contact heels and beams extending from corresponding contact heels. The contact heels are soldered to corresponding first pads. The contacts are singulated from the carrier after the contact heels are soldered to the first pads. The carrier is removed from the substrate after the contacts are singulated leaving the individual contacts soldered to corresponding first pads.

In another embodiment, a land grid array interconnect is provided having a substrate that has a first surface having first pads thereon. A contact array is coupled to the first surface of the substrate. The contact array is formed from a metal plate. The contact array has a plurality of contacts initially partially etched from the metal plate to from contact heels and beams extending from corresponding contact heels. The beams are bent out of plane with respect to the contact heels. The beams have tips that define a separable interface for interfacing with an electronic component. The contact heels are soldered to corresponding first pads. The metal plate is separated from the soldered contact heels that leave the individual contacts soldered to corresponding first pads.

In a further embodiment, a land grid array interconnect is provided having a substrate that has a first surface and a second surface. The substrate has a plurality of conductive vias extending therethrough. The substrate has first pads on the first surface electrically connected to corresponding vias. A contact array is coupled to the first surface of the substrate. The contact array has a plurality of contacts. The contacts have contact heels and beams that extend from corresponding contact heels to tips that define a separable interface for interfacing with an electronic component. The contact heels have openings therethrough aligned with corresponding first pads that are electrically connected to corresponding first pads using a conductive epoxy within the corresponding opening and engaging the corresponding first pad.

DETAILED DESCRIPTION OF THE INVENTION

The subject matter herein relates to a land grid array (LGA) interconnect and method of manufacturing the same. When used herein, the term LGA is meant to define many different interconnects. For example, it could be interpreted to mean a chip interconnect for connecting a chip to a printed circuit board. However, it could also mean a board-to-board interconnect. In the illustrated embodiments herein, the subject matter will be described by way of an interconnect to a chip.

Figure 1:
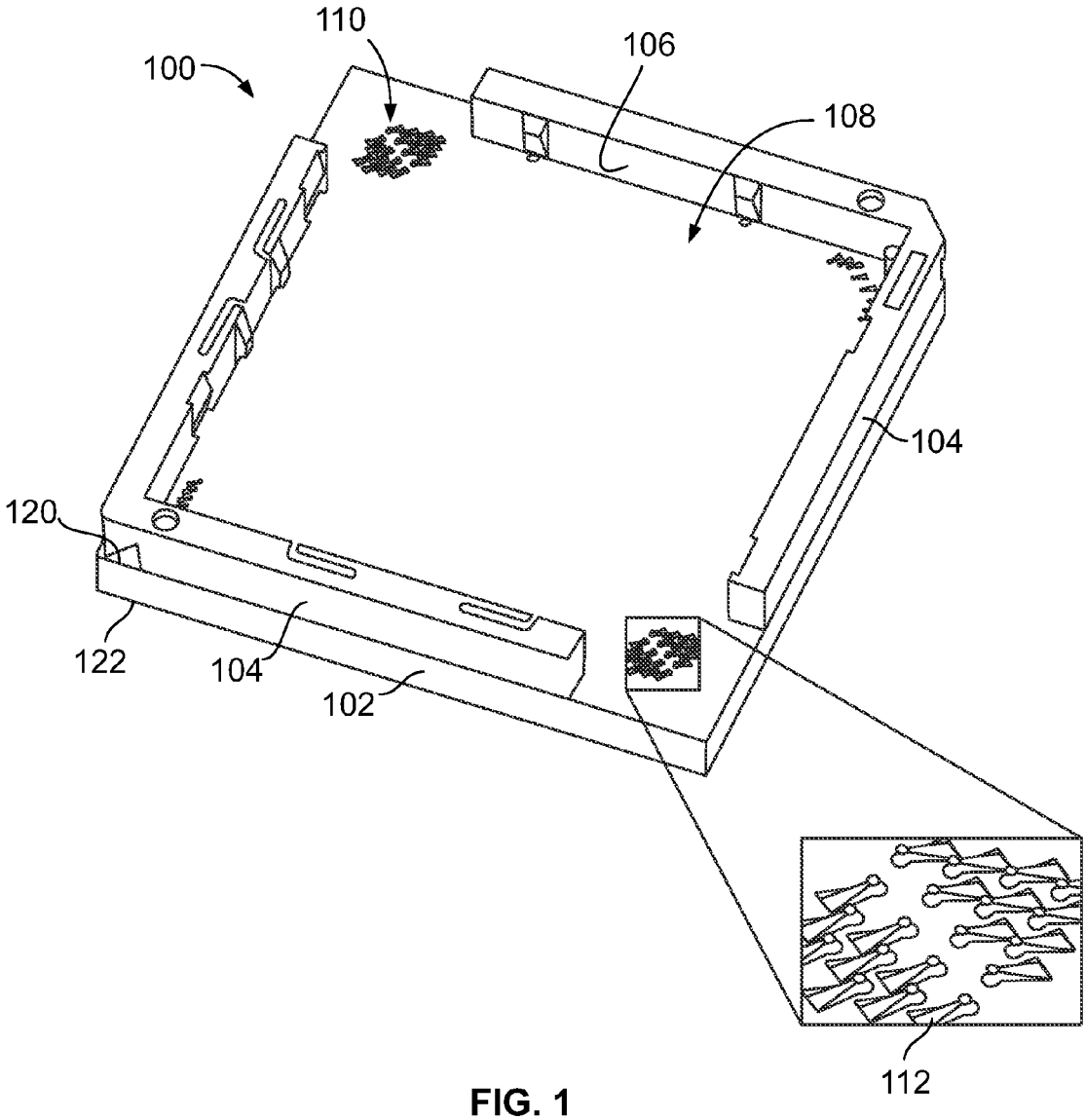
FIG. 1 is top perspective view of an LGA interconnect formed in accordance with an exemplary embodiment.

FIG. 1 is top perspective view of an LGA interconnect 100 formed in accordance with an exemplary embodiment. The interconnect 100 includes a substrate 102 and a housing 104 including guide walls 106. The guide walls 106 define an inner chip receiving nest 108 that is configured to receive an electronic component (not shown), such as a chip. The LGA interconnect 100 defines a socket for receiving the electronic component. A contact array 110 is provided on the substrate 102 that defines a separable interface for interfacing with the electronic component received within the nest 108.

The contact array 110 includes a plurality of individual contacts 112, only a portion of which are shown in FIG. 1. Optionally, the entire nest 108 may be filled with contacts 112 arranged in a predetermined pattern that corresponds with a pattern of lands or balls on the electronic component. Any number of contacts 112 may be provided. In the illustrated embodiment, the contacts 112 are arranged in a grid of approximately 50 contacts by 50 contacts. A portion of the contact array 110 is enlarged to show a more detailed view of the contacts 112.

The substrate 102 extends between a first side 120 and a second side 122. The contact array 110 is provided along the first side 120. The second side 122 is configured to be mounted to another component, such as a printed circuit board (not shown). The second side 122 may be soldered to the printed circuit board using an array of solder balls. Other attachment means are possible in alternative embodiments. In some alternative embodiments, a second contact array may be attached to the second side 120. In the illustrated embodiment, the housing 104 is mounted to the first side 120. Alternatively, the housing 104 may surround the substrate 102 such that the substrate 102 is received within the housing 104.

Figure 2:
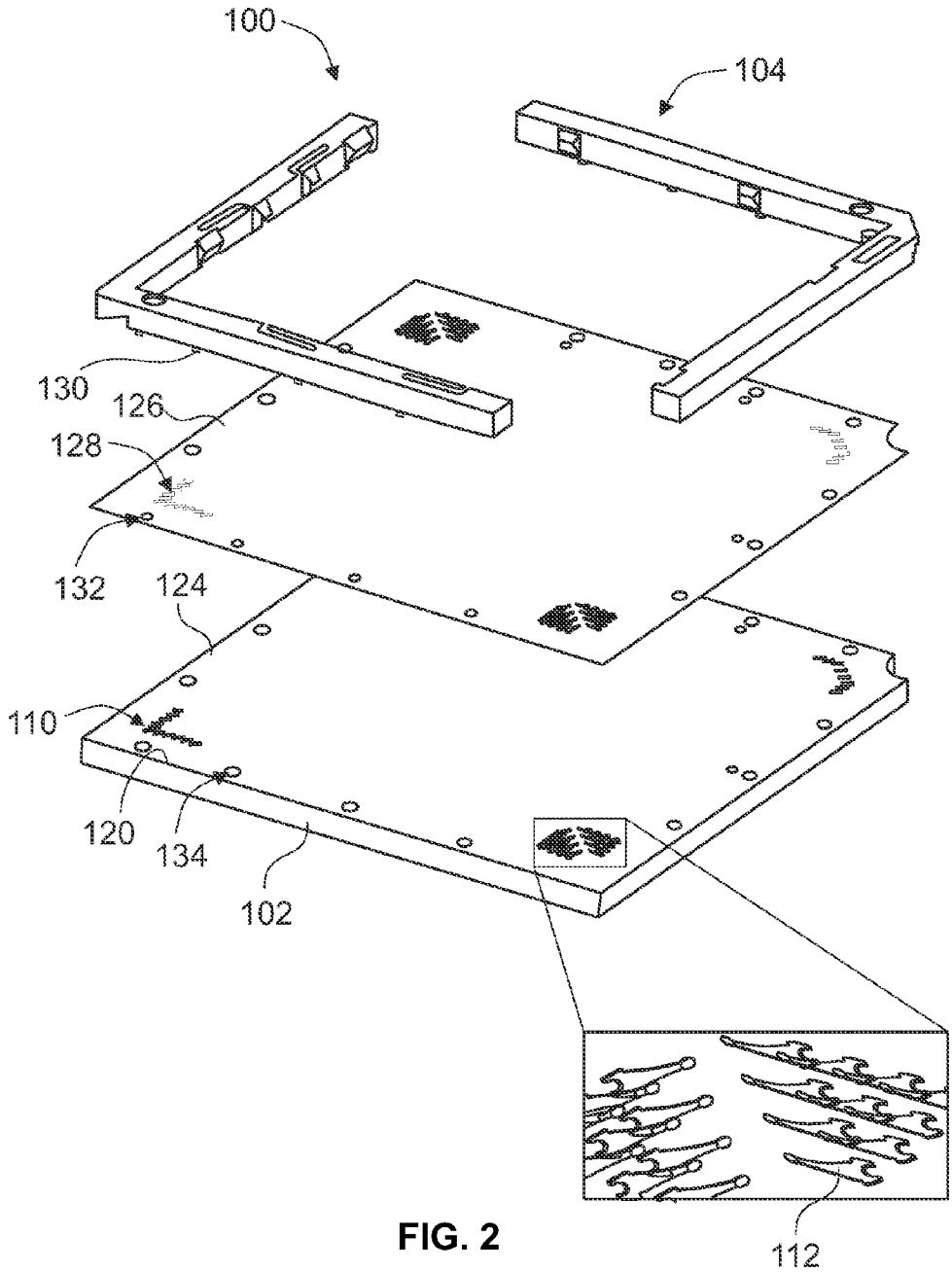
FIG. 2 is an exploded view of the LGA interconnect.

FIG. 2 is an exploded view of the LGA interconnect 100. The contact array 110 is coupled to the first side 120 of the substrate 102. A portion of the contact array 110 is enlarged showing the contacts 112 attached to the first side 120 of the substrate 102. A solder mask 124 is applied to the first side 120 to define soldering locations for the contacts 112.

The interconnect 100 includes a coverlay 126 that is applied over the contact array 110. The coverlay 126 includes openings 128 that fit around the contacts 112 when the coverlay 126 is coupled to the first side 120 of the substrate 102. The coverlay 126 defines a spacer for the contacts 112 so that the contacts 112 do not bottom out against the substrate 102 when the electronic component is coupled to the interconnect 100.

The housing 104 is mounted to the substrate 102 over the coverlay 126. The housing 104 may be secured to the substrate 102 using fasteners (not shown). Posts 130 may extend downward from the housing 104 through post holes 132 in the coverlay 126. The posts 130 are received in post holes 134 in the substrate 102 to position the housing 104 with respect to the substrate 102.

Figure 3:
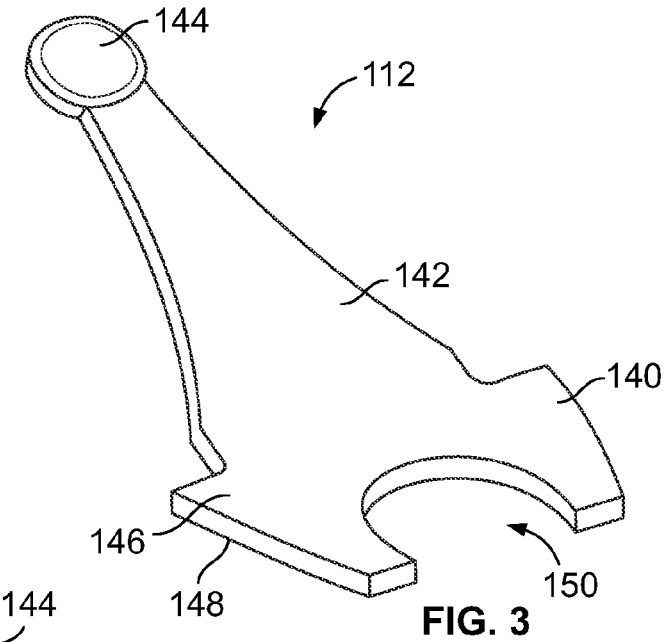
FIG. 3 illustrates a contact used with the LGA interconnect.

FIG. 3 illustrates one of the contacts 112. The contact 112 includes a contact heel 140 and a beam 142 extending from the contact heel 140. The beam 142 extends to a tip 144. The tip 144 defines a separable interface for interfacing with the electronic component received in the interconnect 100 (shown in FIG. 1). In an exemplary embodiment, the beam 142 is bent at an angle with respect to the contact heel 140. The beam 142 is cantilevered from the contact heel 140 to the tip 144.

Optionally, the tip 144 may be formed to have a convex shape. The outer surface of the tip 144 defines a wiping surface for wiping against the land on the electronic component. In the illustrated embodiment, the tip 144 has a truncated spherical shape. The outer surface of the tip 144 is bulged outward. The tip 144 may be formed by pressing the bottom of the tip 144 to form the convex shape. The tip 144 may have other shapes in alternative embodiments.

The contact heel 140 has an upper surface 146 and a lower surface 148. The upper and lower surfaces 146, 148 are planar and parallel to one another. The lower surface 148 defines a mounting surface for mounting the contact 112 to the substrate 102. In an exemplary embodiment, the lower surface 148 is configured to be soldered to the substrate 102.

The contact heel 140 includes a cut out 150. In the illustrated embodiment, the cut out 150 is generally circular in shape. Optionally, the tip 144 of another contact 112 may be nested within the cut out 150. The tip 144 of the adjacent contact 112 may be formed within the cut out 150, such as by etching the tip 144 away from the contact heel 140.

In an exemplary embodiment, the contact 112 is manufactured from a conductive material, such as copper or a copper alloy. Portions of the contact 112 may be plated. For example, the upper surface 146 and the beam 142 may be nickel plated. The tip 144 may be plated with hard gold. Optionally, the lower surface 148 may not be plated, but rather include an organic solderability preservative (OSP) coating.

Figure 4:
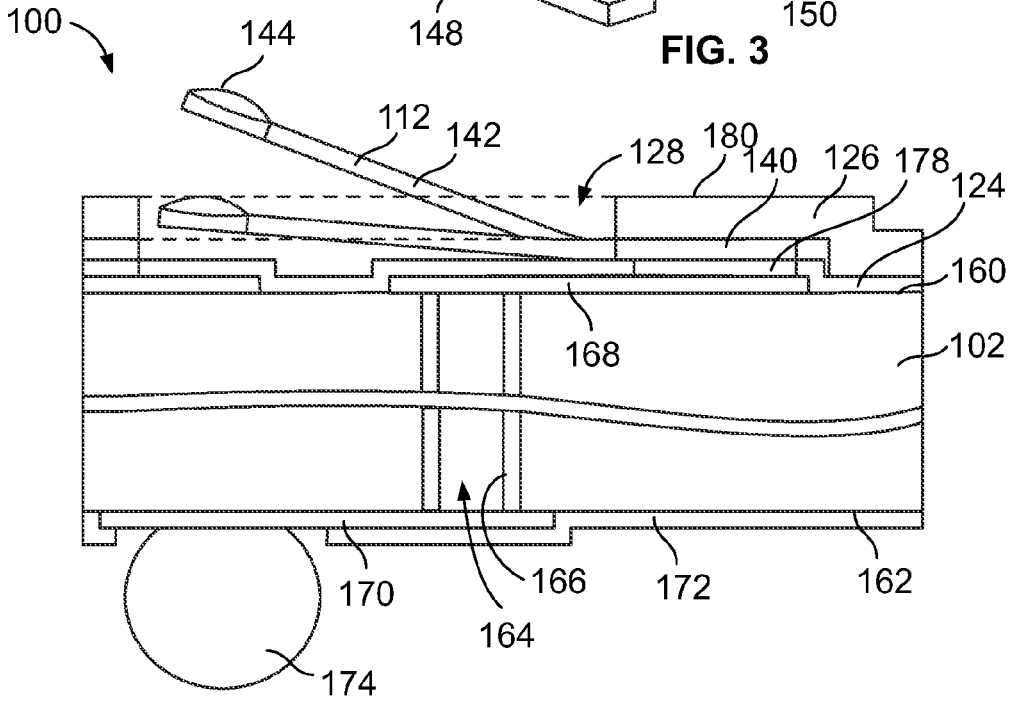
FIG. 4 is a cross-sectional view of a portion of the LGA interconnect.

FIG. 4 is a cross-sectional view of a portion of the LGA interconnect 100. The substrate 102 has a first surface 160 and a second surface 162 opposite to the first surface 160. A plurality of vias 164 (only one of which is shown FIG. 4) extend through the substrate 102. The vias 164 are plated with a plating layer 166 between the first and second surfaces 160, 162. A first pad 168 is provided along the first surface 160. A second pad 170 is provided along the second surface 162. The plating layer 166 electrically connects the first and second pads 168, 170.

A solder mask 172 is provided over the second surface 162 and/or a portion of the second pad 170. A solder ball 174 is soldered to the second pad 170. In alternative embodiments, rather than attaching solder balls 174 to the second surface 162, another contact array may be provided on the second surface 162.

The solder mask 124 is provided over the first surface 160 and/or a portion of the first pad 168. Solder 178 is provided between the first pad 168 and the contact 112 to electrically connect the contact 112 to the first pad 168. The contact heel 140 is soldered to the first pad 168 using the solder 178. The contact heel 140 may be attached by other means, such as welding, using conductive epoxy and the like.

The beam 142 extends from the contact heel 140 away from the first surface 160. The beam 142 is deflectable and may be deflected toward the substrate 102 when the electronic component is attached to the LGA interconnect 100. The coverlay 126 extends over the substrate 102 and may cover a portion of the contact 112, such as the contact heel 140. The opening 128 is aligned with the beam 142 such that the contact 112 may extend through the coverlay 126. As the electronic component is loaded into the interconnect 100, the electronic component engages an outer surface 180 of the coverlay 126 to define a stop for the electronic component. When the electronic component engages the outer surface 180, the beam 142 is positioned within the opening 128. In an exemplary embodiment, the beam 142 may still be angled out of plane with respect to the contact heel 140 such that the tip 144 is spaced apart from the first surface 160 and the solder mask 124 extending over the first surface 160.

Figure 5:
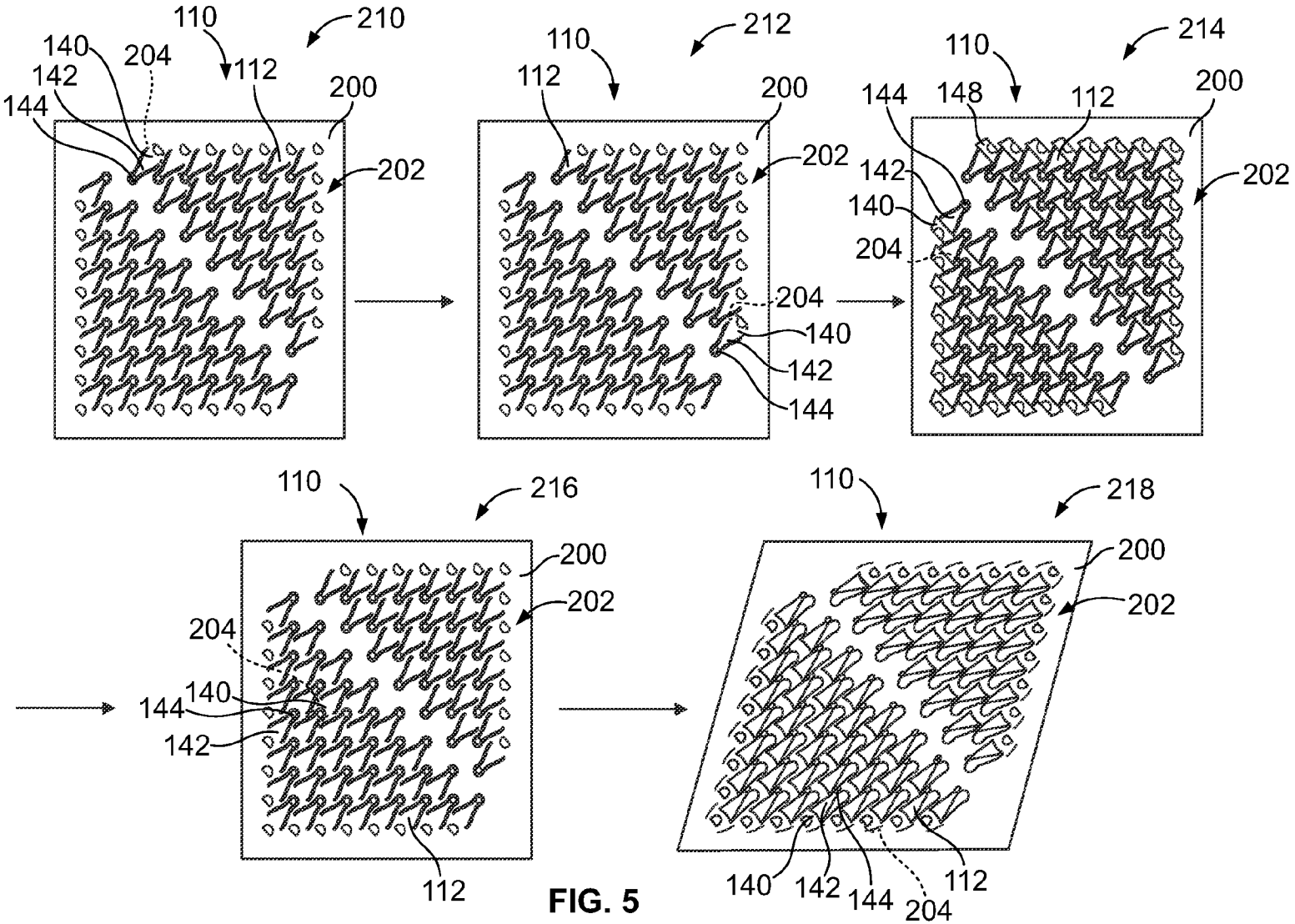
FIG. 5 shows a process for manufacturing a contact array of the LGA interconnect.

FIG. 5 shows a process for manufacturing the contact array 110. The contact array 110 includes a metal plate 200, such as a copper alloy sheet having predetermined dimensions that are similar in size to the substrate 102 (shown in FIG. 1). The metal plate 200 is etched during an etching process 210 to define a plurality of the contacts 112 held by a carrier 202 which is part of the metal plate 200. The etching process 210 may be chemical etching or another type of etching in an alternative embodiment. Other processes may be used to begin forming the contacts 112 from the metal plate 200, such as a stamping process or another process to at least partially singulate the contacts 112 from the metal plate 200.

The contacts 112 and the carrier 202 lie within the plane of the metal plate 200. Portions of the contacts 112 are connected to the carrier 202 such that each of the contacts 112 of the contact array 110 are connected together by the carrier 202. The carrier 202 will later be removed by singulating the contacts 112 from the carrier 202.

The contacts 112 are attached to the carrier 202 at sacrificial segments 204, examples of which are shown in FIG. 5 by the dashed lines. The sacrificial segments 204 are later removed to singulate the contacts 112 from the carrier 202. The etching process generally defines the contact heels 140 and the beams 142. The sacrificial segments 204 generally extend along the contact heels 140. Optionally, the metal plate 200 may be partially etched in the areas of the sacrificial segments 204 removing a portion of the metal plate 200 in the areas of the sacrificial segments 204. For example, approximately half of the metal plate 200 may be etched away, reducing the thickness of the metal plate 200 in the area of the sacrificial segments 204. The sacrificial segments 204 may be fully removed at a later time to singulate the contacts 112 from the carrier 202.

The metal plate 200 may then optionally undergo a tip forming process 212. During the tip forming process 212 the tips 144 of the beams 142 are shaped or formed into a convex shape. The tips 144 may be formed into any shape in alternative embodiments.

The metal plate 200 undergoes one or more plating processes 214, 216. During the plating process 214, the metal plate 200 is nickel plated all over the metal plate 200, except on the lower surface 148 of the contact heels 140. The lower surface 148 of the contact heels 140 remain unplated such that the copper is exposed. Optionally, an OSP coating may be applied to the lower surface 148 of the contact heels 140. Other portions may not be plated in alternative embodiments. Additionally, even the lower surface 148 may be plated in some embodiments. The metal plate 200 may be plated with another material other than nickel in alternative embodiments.

During the plating process 216, the tips 144 are plated with a hard gold. The tips 144 may be plated with another material in alternative embodiments. Optionally, the plating processes 214, 216 may be plated using a photolithographic process, such as a dry film photo resist plating process. Other types of plating processes may be used in alternative embodiments.

The metal plate 200 undergoes a beam forming process 218. During the beam forming process 218, the beams 142 are bent out of the plane of the metal plate 200. The beams 142 are bent upward from the contact heels 140 to a predetermined angle. For example, the beams 142 may be bent to approximately a 30° angle from the metal plate 200.

Figure 6:
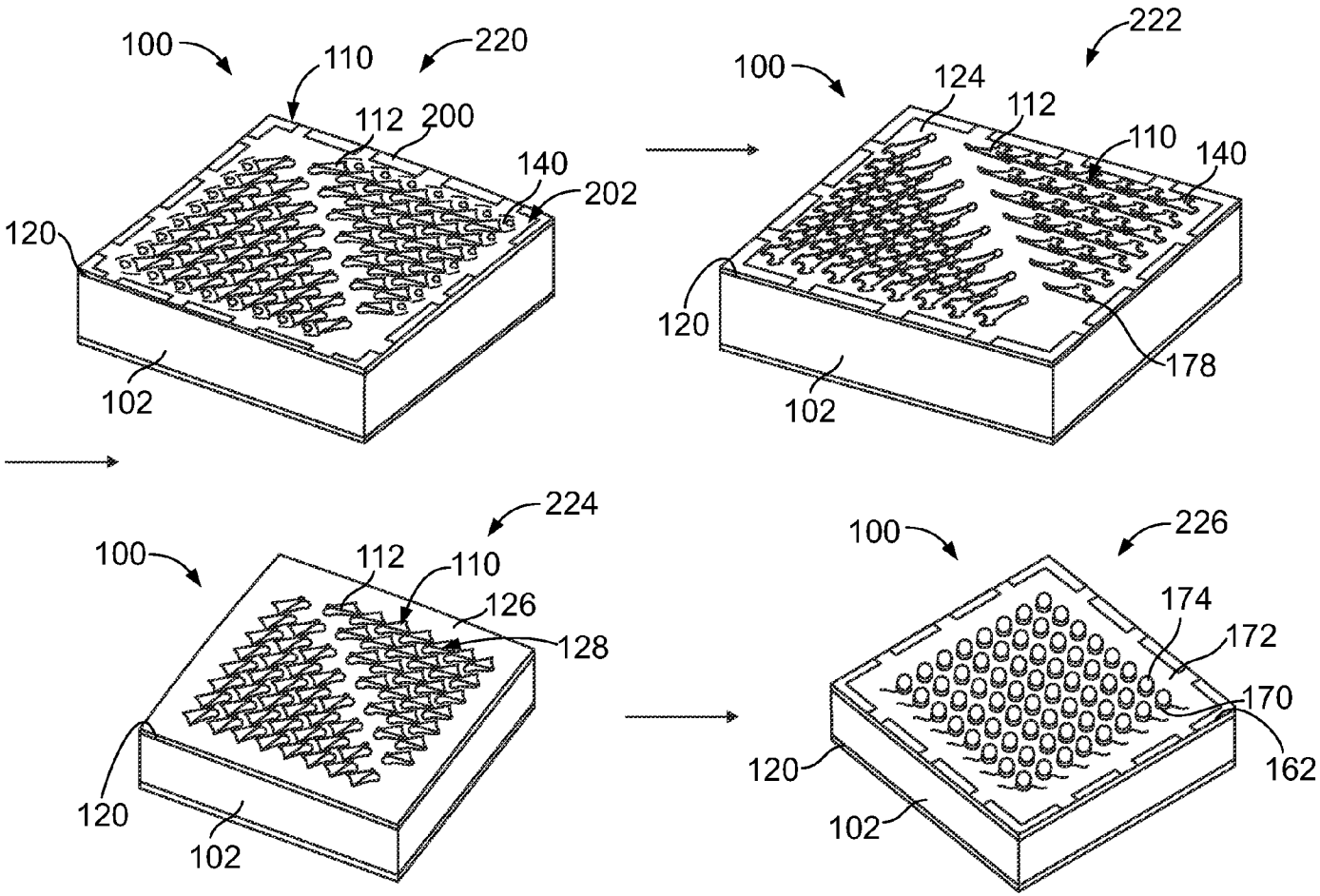
FIG. 6 shows processes for assembling the LGA interconnect.

FIG. 6 shows processes for assembling the LGA interconnect 100. The contact array 110, which may be manufactured according to the processes shown in FIG. 5, is attached to the substrate 102. The carrier 202 and attached contacts 112 are positioned on the first side 120 of the substrate 102. The solder mask 124 may cover the first side 120 of the substrate 102 with solder 178 positioned within openings of the solder mask 124 on the first pads 168 (shown in FIG. 2). The carrier 202 is placed on the substrate 102 such that the contact heels 140 are aligned with the first pads 168. The solder 178 (shown in FIG. 4) is positioned between the contact heels 140 and the first pads 168. The substrate 102 and contact array 110 undergo a reflow soldering process 220 to mechanically and electrically connect the contact heels 140 with corresponding first pads 168.

In an exemplary embodiment, because the LGA interconnect 100 is later subjected to a secondary soldering operation to solder the solder balls 174 to the substrate 102, the soldering process 220 used to solder the contacts 112 to the substrate 102 uses a higher temperature solder for the initial soldering, and a lower temperature solder for the secondary soldering of the solder balls 174. For example, the solder 178 between the contacts 112 and the substrate 102 may be an indalloy 259 having a liquidus temperature of approximately 272° C. and a solidus temperature of a approximately 250° C. The secondary soldering of the solder balls 174 may use an indalloy 256 having a liquidus temperature of approximately 220° C. and a solidus temperature of a approximately 217° C. Other types of solder may be used in alternative embodiments.

The carrier 202 is not secured to or fixed to the substrate 102. Rather, the carrier 202 is configured to be removed from the substrate 102 after the contacts 112 are soldered to the substrate 102. The contacts 112 are attached to the carrier 202 using the sacrificial segments 204 (shown in FIG. 5) such that the contacts 112 and the carrier 202 are held together as a unit and attached to the substrate 102 as a unit. No other structure is needed to hold the contacts 112 for mounting to the substrate 102. For example, a laminate is not used to hold the contacts 112, but rather the contacts 112 are directly held by the carrier 202 which is part of the metal plate 200. The contacts 112 remain attached to the carrier 202 until after the contacts 112 are soldered.

After the contacts 112 are soldered to the substrate 102, the contacts 112 are singulated from the carrier 202 during a singulation process 222. The carrier 202 is then removed from the substrate 102 and the contacts 112. During the singulation process 222, the sacrificial segments 204, which attach the contacts 112 to the carrier 202, are removed. The sacrificial segments 204 may be removed by a laser cutting process. Other processes may be used to singulate the contacts 112 and remove the carrier 202. For example, an etching process may be used to remove the sacrificial segments 204. With the carrier 202 removed, the contacts 112 remain attached to the substrate 102 by the solder 178 between the contact heels 140 and the first pads 168. No additional step is required to electrically connect the contacts 112 to the first pads 168 (shown in FIG. 4). For example, no portion of the substrate 102 needs to be metalized to create a conductive path between the contacts 112 and the first pads 168 because the contacts 112 are directly soldered to the first pads 168 using the solder 178.

After the carrier 202 is removed, the coverlay 126 is attached to the substrate 102. The coverlay 126 may be attached to the substrate 102 using a lamination process 224. Other processes may be used to attach the coverlay 126 to the substrate 102. During the lamination process 224, heat and pressure are applied to the coverlay 126 to affix the coverlay 126 to the substrate 102. The contacts 112 extend through the openings 128 and the coverlay 126 for interfacing with the electronic component.

The solder balls 174 are soldered to the substrate 102 during a secondary soldering process 226. The solder mask 172 covers the second surface 162 of the substrate 102 leaving portions of the second pads 170 exposed. The solder balls 174 are soldered to the second pads 170 during the secondary soldering process 226. As describe above, the secondary soldering process 226 is performed at a lower temperature than the initial process used to solder the contacts 112 to the substrate 102. Once the solder balls 174 are attached to the substrate 102, the housing 104 is attached on the LGA interconnect 100 for receiving the electronic component. The LGA interconnect 100 is ready to be attached to the printed circuit board.

Figure 7:
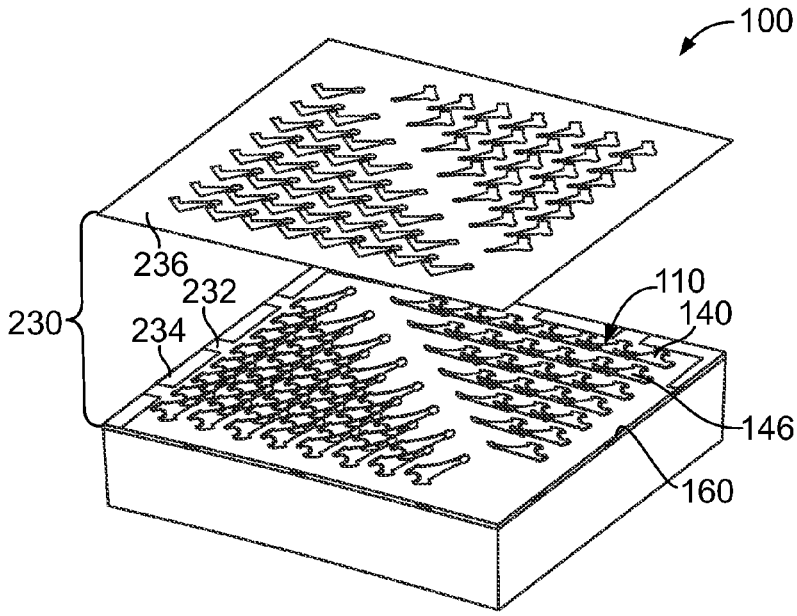
FIG. 7 illustrates an alternative coverlay for the LGA interconnect.

FIG. 7 illustrates an alternative coverlay 230 for the LGA interconnect 100. The coverlay 230 includes two layers. A lower coverlay layer 232 is placed on top of the first surface 160 and generally surrounds the contact array 110. A top surface 234 of the lower coverlay layer 232 is generally coplanar with the upper surfaces 146 of the contact heels 140. An upper coverlay layer 236 is placed over the lower coverlay layer 232 and over the contact heels 140. The upper coverlay layer 236 covers portions of the contact heels 140.

Figure 8:
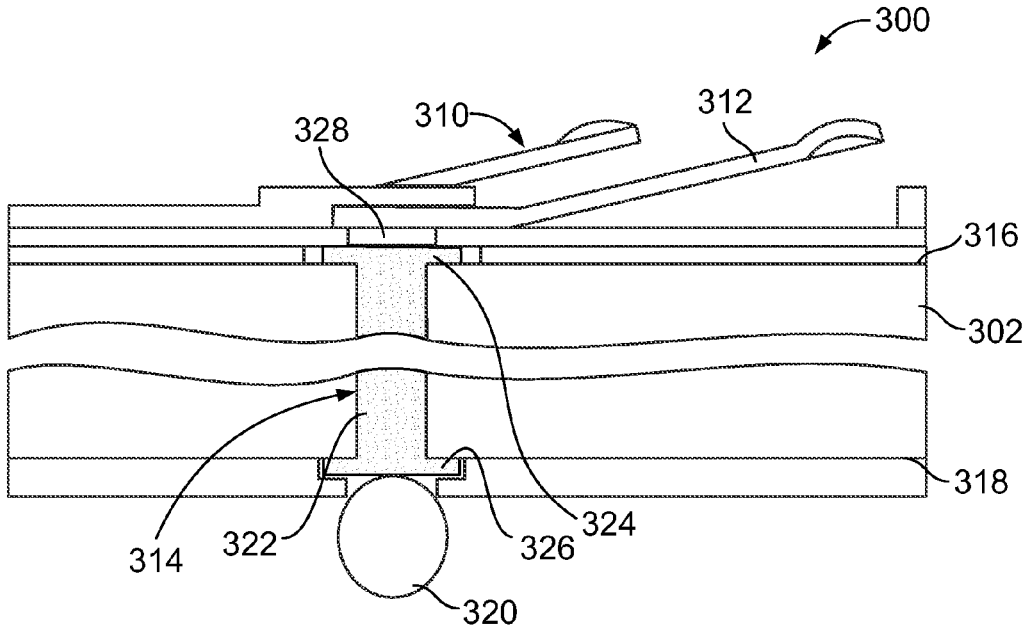
FIG. 8 is a cross-sectional view of a portion of an alternative LGA interconnect formed in accordance with an alternative embodiment.

FIG. 8 is a cross-sectional view of a portion of an alternative LGA interconnect 300 formed in accordance with an alternative embodiment. The interconnect 300 includes a substrate 302 with a contact array 310 attached to the substrate 302. The contact array 310 includes a plurality of contacts 312.

The substrate 302 includes vias 314 extending between a first surface 316 and a second surface 318. Solder balls 320 are attached to the substrate 302 at the second surface 318. The contacts 312 are attached to the substrate 302 at the first surface 316. In the illustrated embodiment, the vias 314 are filled with conductive material 322 between the first surface 316 and the second surface 318. The conductive material 322 plugs the vias 314. In the illustrated embodiment, the conductive material 322 entirely fills the vias 314. Alternatively, the conductive material 322 may only partially fill the vias 314. For example, the conductive material 322 may plug the vias 314 only at the first surface 316 and/or the second surface 318 while the remainder of the vias 314 is plated.

The substrate 302 includes a first pad 324 at the first surface 316 and a second pad 326 at the second surface 318. The first pad 324 is defined by the conductive material 322 at the first surface 316. The first pad 324 is aligned with the via 314 directly above the via 314. Alternatively, the first pad 324 may be offset from the via 314. The contact 312 is soldered to the first pad 324 using solder 328. The solder 328 engages the first pad 324 and the contact 312 to create a direct electrical path between the contact 312 and the conductive material 322 of the via 314. The solder 328 mechanically and electrically couples the contact 312 to the substrate 302.

The contact array 310 may be attached to the substrate 302 in a similar manner as described above with respect to the contact array 110 being coupled to the substrate 102. For example, the contact array 310 may include a carrier that holds the individual contacts 312 that is attached to the substrate 302 and then the contacts 312 singulated from the carrier such that the carrier may be removed from the substrate 302.

Figure 9:
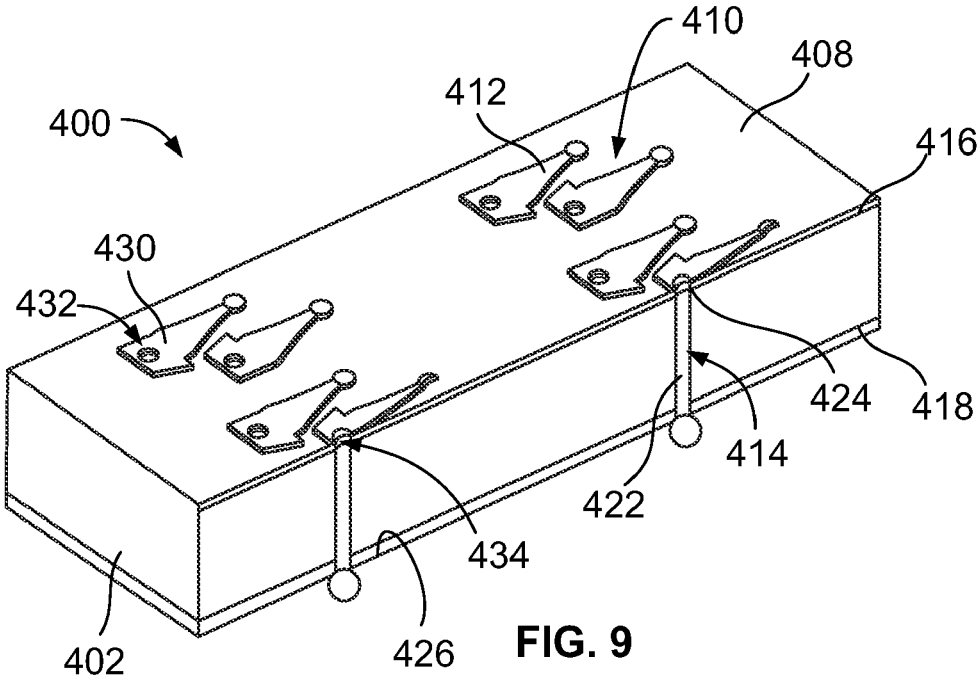
FIGS. 9 and 10 illustrate an alternative LGA interconnect formed in accordance with an alternative embodiment.
Figure 10:
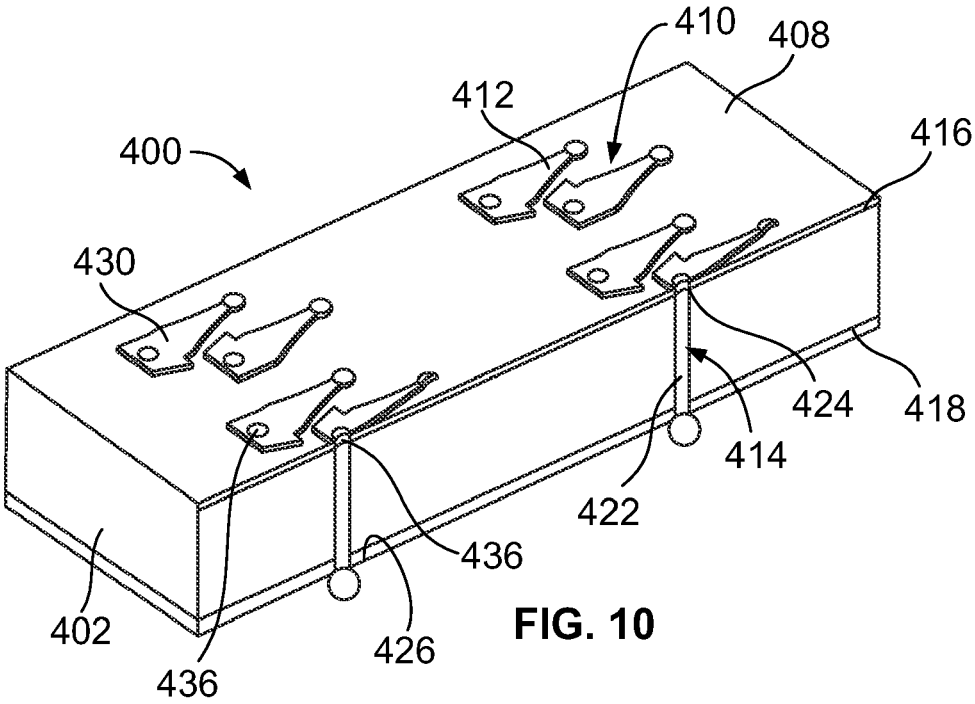

FIGS. 9 and 10 illustrate an alternative LGA interconnect 400 formed in accordance with an alternative embodiment. The interconnect 400 includes a substrate 402 and a contact array 410 attached to the substrate 402. The contact array 410 includes a plurality of contacts 412 that are attached to a bond member 408. The bond member 408 may be a sheet or laminate that may be secured to the substrate 402, such as by a lamination process by applying heat and pressure. The contacts 412 may be attached to the bond member 408, such as by a lamination process. For example, the contact array 410 may initially include a metal plate that defines a carrier and the contacts 412. The carrier and contacts 412 may be laminated to the bond member 408, and then the contacts 412 may be singulated from the carrier such that the carrier may be removed leaving the contacts 412 attached to the bond member 408. In an exemplary embodiment, the bond member 408 is non-conductive. The contacts 412 are spaced apart on the bond member 408 in a predetermined pattern.

The substrate 402 includes a plurality of vias 414 extending between a first surface 416 and a second surface 418. In an exemplary embodiment, the vias 414 are plugged with a conductive material 422. Optionally, the vias 414 may be entirely filled the conductive material 422. The conductive material 422 forms a first pad 424 on the first surface 416 and second pad 426 on the second surface 418. The first and second pads 424, 426 are aligned with the vias 414.

The bond member 408 is attached to the substrate 402 such that contact heels 430 of the contacts 412 are aligned with the first pads 424. The contact heels 430 have openings 432 (shown in FIG. 9) therethrough. The bond member 408 also includes openings 434 therethrough that are aligned with the openings 432. When the bond member 408 is attached to the substrate 402, the openings 432, 434 are aligned with, and provide access to, the first pads 424. Conductive epoxy 436 (shown in FIG. 10) fills the openings 432, 434 to electrically connect the contacts 412 with the first pads 424. An electrical path is created between the contacts 412 and the first pads 424 through the conductive epoxy 436.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A land grid array interconnect comprising:

a substrate having a first surface and a second surface, the substrate having a plurality of vias extending therethrough, the substrate having first pads on the first surface electrically connected to corresponding vias, the substrate having second pads on the second surface electrically connected to corresponding vias and corresponding first pads; and a contact array coupled to the first surface of the substrate, the contact array having a metal plate that defines a carrier and a plurality of contacts formed from the metal plate and held by the carrier, the contacts having contact heels and beams extending from corresponding contact heels, the contacts being attached to the carrier at sacrificial segments, the sacrificial segments being formed by partially etching the metal plate, the metal plate along the sacrificial segments has a thickness less than a thickness of the contact heels, the contact heels being attached to corresponding first pads, the contacts being singulated from the carrier after the contact heels are soldered to the first pads by cutting the partially etched sacrificial segments, the carrier being removed from the substrate after the contacts are singulated leaving the individual contacts soldered to corresponding first pads.

2. The land grid array interconnect of claim 1, further comprising a coverlay applied over the contacts after the carrier is removed.

3. The land grid array interconnect of claim 1, wherein the metal plate is etched to define the contacts and the carrier, the contacts being laser cut to singulate the contact from the carrier.

4. The land grid array interconnect of claim 1, wherein solder provides a direct electrical path between the contacts and the corresponding first pad.

5. The land grid array interconnect of claim 1, wherein the substrate includes a solder mask applied to the first surface, the metal plate resting directly on the solder mask.

6. The land grid array interconnect of claim 1, wherein the beams have tips defining a separable interface for interfacing with an electronic component, the tips being arranged at approximately a 1 mm pitch.

7. The land grid array interconnect of claim 1, wherein the beams have tips defining a separable interface for interfacing with an electronic component, the tips being formed to define a truncated sphere having a convex shape.

8. The land grid array interconnect of claim 1, wherein the contacts are plated prior to coupling the contact array to the first surface of the substrate.

9. The land grid array interconnect of claim 1, the sacrificial segments being laser cut to singulate the contacts after the contact heels are soldered to the first pads.

10. The land grid array interconnect of claim 1, the sacrificial segments being partially etched such that the sacrificial segments have a thickness less than a thickness of the metal plate.

11. The land grid array interconnect of claim 1, the contacts being connected to the carrier only by the sacrificial segments.

12. The land grid array interconnect of claim 1, wherein the contacts have a nested configuration such that tips of the beams are formed within a portion of the contact heel of another contact.

13. A land grid array interconnect comprising:

a substrate having a first surface having first pads thereon; and a contact array coupled to the first surface of the substrate, the contact array being formed from a metal plate, the contact array having a plurality of contacts initially partially etched from the metal plate to form etched lines along the contact heels, the metal plate along the partially etched lines has a thickness less than a thickness of the contact heels, the contacts having beams extending from corresponding contact heels, the beams being bent out of plane with respect to the contact heels, the beams having tips defining a separable interface for interfacing with an electronic component, the contact heels being soldered to corresponding first pads, the metal plate being separated from the soldered contact heels along the partially etched lines leaving the individual contacts soldered to corresponding first pads.

14. The land grid array interconnect of claim 13, wherein the metal plate is etched to define the contacts and the carrier, the contacts being laser cut to singulate the contact from the carrier.

15. The land grid array interconnect of claim 13, wherein the substrate includes a solder mask applied to the first surface, the metal plate resting directly on the solder mask.

16. The land grid array interconnect of claim 13, wherein the contacts are attached to the carrier at sacrificial segments defined along the partially etched lines, the sacrificial segments being laser cut to singulate the contacts after the contact heels are soldered to the first pads.

* * * * *